United States Patent [19]

Bray

[11] Patent Number: 4,771,311

[45] Date of Patent: Sep. 13, 1988

[54] DEVELOPMENT APPARATUS

[75] Inventor: Daniel M. Bray, Rochester, N.Y.

[73] Assignee: Xerox Corporation, Stamford, Conn.

[21] Appl. No.: 905,105

[22] Filed: Sep. 8, 1986

[51] Int. Cl.[4] ..... G03G 15/00

[52] U.S. Cl. ..... 355/3 DD; 355/15; 118/652

[58] Field of Search ..... 355/4, 14 D, 3 DD, 15; 118/652, 657, 658

[56] References Cited

U.S. PATENT DOCUMENTS

| | | | |
|---|---|---|---|
| 3,654,902 | 4/1972 | Hakanson | 118/637 |
| 4,041,903 | 8/1977 | Katakura et al. | 118/658 |
| 4,077,358 | 3/1978 | Kito | 355/4 X |
| 4,135,927 | 1/1979 | Draugelis et al. | 355/4 X |
| 4,142,165 | 2/1979 | Miyakawa et al. | 355/3 DD X |
| 4,320,958 | 3/1982 | Fantuzzo | 118/658 X |
| 4,400,078 | 8/1983 | Mayer | 355/14 D X |
| 4,403,852 | 9/1983 | Hirabayashi et al. | 355/15 |
| 4,464,041 | 8/1984 | Haneda et al. | 355/3 DD |
| 4,572,631 | 2/1986 | Kondo | 355/3 DD |

*Primary Examiner*—Patrick R. Salce
*Assistant Examiner*—Kristine Peckman
*Attorney, Agent, or Firm*—H. Fleischer; J. E. Beck; R. Zibelli

[57] ABSTRACT

An apparatus in which a latent image is developed with marking particles. In one mode of operation, the marking particles advance to the latent image. In another mode of operation, the marking particles are diverted from the latent image to prevent development thereof. A system of this type is particularly useful in color electrophotographic printing wherein successive electrostatic latent images are developed with different color marking particles.

15 Claims, 2 Drawing Sheets

DEVELOPMENT APPARATUS

This invention relates generally to an electrophotographic printing machine, and more particularly concerns an improved development apparatus for use therein.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing marking particles into contact therewith. This forms a powder image on the photoconductive member which is subsequently transferred to a copy sheet. The copy sheet is heated to permanently affix the marking particles thereto in image configuration.

Various types of development systems have hereinbefore been employed. These systems utilize two component developer mixes or single component developer materials. Typical two component developer mixes employed are well known in the art, and generally comprise dyed or colored thermoplastic powders, known in the art as toner particles, which are mixed with coarser carrier granules, such as ferromagnetic granules. The toner particles and carrier granules are selected such that the toner particles acquire the appropriate charge relative the electrostatic latent image recorded on the photoconductive surface. When the developer mix is brought into contact with the charged photoconductive surface the greater attractive force of the electrostatic latent image recorded thereon causes the toner particles to transfer from the carrier granules and adhere to the electrostatic latent image.

Heretofore, development systems have employed rotary impellers, fur brushes, bucket conveyors and magnetic brush systems to achieve the requisite uniformity in toner deposition. The magnetic brush system achieves a high degree of uniform deposition and, therefore, numerous electrophotographic printing machines utilize this type of development system. Usually, a magnetic brush system includes a developer roller having a directional flux field to bring the magnetizable developer mix into contact with the charged photoconductive surface. Multicolor electrophotographic printing involves the utilization of various processing components adapted to produce a series of electrostatic latent images corresponding to a particular color in the original document. In a system of this type, successive partial color images are developed. Each partial color image is developed with toner particles corresponding in color to the partial color image utilized to form the respective electrostatic latent image on the photoconductive surface.

Generally, the developer roller of the magnetic brush development system is mounted fixedly relative to the photoconductive surface. This restricts the quality of multicolor copies. A multicolor development system utilizes a plurality of developer rollers, each being adapted to furnish the appropriately colored toner particles to the photoconductive surface. Developer rollers which are fixedly mounted are positioned closely adjacent to the photoconductive surface. In this way, the developer roller having the developer mix adhering thereto deposits toner particles on the photoconductive surface. However, a developer mix having toner particles of one color contacts the toner powder image of another color resulting in intermingling of colors and mechanical scraping of the toner powder image. This results in the toner powder image being wrongly colored and the multi-color copy produced thereby lacking the appropriate color balance, i.e. the color does not correspond to the color in the original document being copied. To overcome this problem, the developer housings have been mounted movably in the printing machine. Thus, one developer housing is positioned in the operative location with the remaining developer housings being spaced from the photoconductive surface. In this way, successive developer housings are located adjacent the photoconductive surface to develop the electrostatic latent image while the other developer housings remain spaced therein in the inoperative position. An electrophotographic printing machine utilizing the foregoing type of development system is the Model No. 6500 made by the Xerox Corporation. A system of this type is rather complex and requires that each developer housing be mounted pivotably. This utilizes additional hardware and increases the cost of the development system. Preferably, it is desirable to maintain the developer housing fixed with respect to the photoconductive surface and to divert the developer material away from the non-operative developer rollers. Various types of techniques have been developed to achieve development in electrophotographic printing machines. The following disclosures appear to be relevant.

- U.S. Pat. No. 3,654,902, Patentee: Hakanson, Issued: Apr. 11, 1972.
- U.S. Pat. No. 4,041,903, Patentee: Katakura et al., Issued: Aug. 16, 1977.
- U.S. Pat. No. 4,403,852, Patentee: Hirabayashi et al., Issued: Sept. 13, 1983.
- U.S. Pat. No. 4,464,041, Patentee: Haneda et al., Issued: Aug. 7, 1984.
- U.S. Pat. No. 4,572,631, Patentee: Kondo, Issued: Feb. 25, 1986.

The relevant portions of the foregoing disclosures may be briefly summarized as follows:

Hakanson discloses an apparatus for applying toner particles to an electrostatic latent image. The apparatus includes two magnetic brushes cooperatively arranged so that their adjacent surfaces move in opposite directions to one another. One of the magnetic brushes is arranged to form a brush of toner particles and to transfer these toner particles to the other magnetic brush which brings it into contact with the electrostatic latent image. Excess toner particles are returned to the supply chamber.

Katakura et al. describes a developing device containing a pair of spaced magnetic rolls for delivering developer material from a storage chamber to an electrostatic recording medium. Each of the magnetic rolls contains a plurality of magnets rotating in opposite directions. One of the magnetic rolls advances the developer material into contact with the electrostatic latent image. The other magnetic roll removes the unused developer material from the first mentioned magnetic roll and returns it to the developer housing sump.

Hirabayashi et al. discloses a developer recovery device for recycling magnetic developer material from a cleaning unit to a developing unit. The recovery device has a revolving element containing a plurality of magnets located at the side of a photosensitive drum. The revolving element conveys the developer material collected by the cleaning unit to the developer unit.

Haneda et al. describes a development apparatus employing a magnetic brush developer roller and a magnetic developer regulating roll. The magnetic developer regulating roll is positioned adjacent the developer roll and controls the amount of toner being transported by the developer roller to the electrostatic latent image recorded on the photoconductive member.

Kondo discloses a development apparatus which includes a first transporting developer roller for delivering magnetic toner from a hopper to a second transporting magnetic developer roller. A second transporting magnetic developer advances toner particles to the electrostatic latent image recorded on the photoconductive surface. Each of the transporting magnetic developer rollers include a plurality of magnets and are rotated in opposite directions.

Pursuant to the features of the present invention, there is provided an apparatus for developing a latent image with marking particles. The apparatus includes means for transporting magnetically the marking particles. Means, operatively associated with the transporting means, control magnetically the marking particles being moved by the transporting means. In one mode of operation, the marking particles are advanced to the latent image by the developing means. The marking particles are attracted to the latent image to develop the latent image. In another mode of operation, the marking particles being advanced by the transporting means are diverted from the latent image to prevent the marking particles from being attracted to the latent image and developing the latent image.

In accordance with another aspect of the present invention, there is provided an electrophotographic printing machine of the type having an electrostatic latent image recorded on a photoconductive member. The improved electrophotographic printing machine includes means for transporting magnetically marking particles. Means, operatively associated with the transporting means, control magnetically the marking particles being moved by the transporting means. In one mode of operation, the marking particles are advanced to the latent image so as to develop the latent image. In another mode of operation, the marking particles are diverted from the latent image to prevent the marking particles from developing the latent image.

In still another aspect of the present invention, there is provided an electrophotographic printing machine of the type in which a first electrostatic latent image recorded on a photoconductive surface is developed with marking particles of one color, and a second electrostatic latent image recorded on the photoconductive member is developed with marking particles of another color. The improved electrophotographic printing machine includes a first developer unit for developing the first electrostatic latent image with marking particles of one color. The first developer unit comprises first means for transporting magnetically the marking particles of one color. First means, operatively associated with the first transporting means, control magnetically the marking particles being moved by the first transporting means. In one mode of operation, the marking particles are advanced to the first electrostatic latent image by the first transporting means and marking particles are attracted thereto so as to develop the first electrostatic latent image with marking particles of one color. In another mode of operation, the marking particles being advanced by the first transporting means are diverted from the second electrostatic latent image to prevent the marking particles from being attracted thereto and developing the second electrostatic latent image. A second developer unit is provided for developing the second electrostatic latent image with marking particles of another color. The second developer unit comprises second means for transporting magnetically marking particles of the other color. Second means, operatively associated with the second transporting means, controls magnetically the marking particles being moved by the second transporting means. In one mode of operation, marking particles are advanced to the second electrostatic latent image by the second transporting means. Marking particles are attracted to the second electrostatic latent image to develop the latent image with marking particles of the other color. In another mode of operation, the marking particles being advanced by the second transporting means are diverted from the first electrostatic latent image to prevent the marking particles from being attracted to the first electrostatic latent image and developing the first electrostatic latent image.

Other aspects of the present invention will become apparent as the following description proceeds and upon reference to the drawings, in which.

Figure 1:
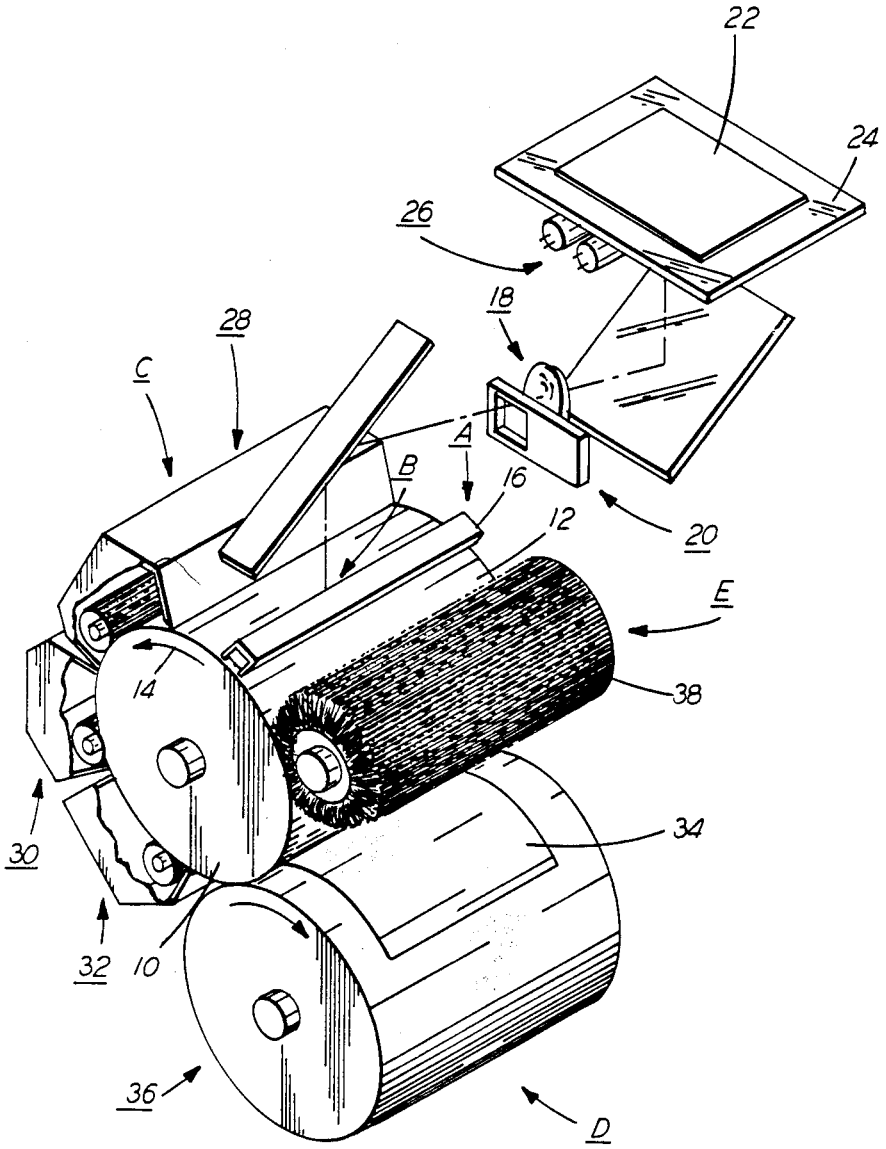
FIG. 1 is a schematic elevational view depicting an electrophotographic printing machine incorporating the development apparatus of the present invention therein.

For a general understanding of the features of the present invention, reference is made to the drawings. In the drawings, like references have been used throughout to designate identical elements. FIG. 1 schematically depicts the various components of an illustrative electrophotographic printing machine incorporating the development apparatus of the present invention therein. It will become evident from the following discussion that the development apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoconductive member such as rotatably mounted drum 10 having a photoconductive surface 12 thereon. Photoconductive surface 12, preferably, is formed from a selenium alloy having a relatively panchromatic response to white light. Drum 10 rotates in a direction indicted by arrow 14 to move photoconductive surface 12 sequentially through a series of processing stations.

Initially, photoconductive surface 12 passes through charging station A. Charging station A has positioned thereat a corona generating device, indicated generally by the reference numeral 16, extending transversely across photoconductive surface 12. Corona generating device 16 charges photoconductive surface 12 to a relatively high, substantially uniform potential.

Next, the charged photoconductive surface is rotated to exposure station B. Exposure station B includes a moving lens system, generally designated by the reference numeral 18, and a color filter mechanism, shown generally by the reference numeral 20. An original document 22 is supported stationarily upon a transparent viewing platen 24. Successive incremental areas of the original document are illuminated by means of a moving lamp assembly, shown generally by the reference numeral 26. Lens system 18 is adapted to scan successive areas of illumination of platen 20 and to focus the light rays on photoconductive surface 12. Lamp assembly 26 and lens system 18 are moved in a timed relationship with respect to the movement of drum 10 to produce a flowing light image of the original document on photoconductive surface 12 in a non-distorted manner. During exposure, filter mechanism 20 interposes selected color filters into the optical light path of lens 18. The color filters operate on the light rays passing through the lens to record an electrostatic latent image on the photoconductive surface corresponding to a specific color of the flowing light image of the original document.

Subsequent to the recording of the electrostatic latent image on photoconductive surface 12, drum 10 rotates the electrostatic latent image to development station C. Development station C includes three individual developer units generally indicated by the reference numerals 28, 30 and 32. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Each of the development units 28, 30 and 32, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive surface 12, while the green light rays will pass through the filter and cause the charge density on the photoconductive surface 12 to be reduced to a voltage level ineffective for development. The charged areas are then made visible by applying green absorbing (magenta) toner particles onto the electrostatic latent image recorded on photoconductive surface 12. Similarly, a blue separation is developed with blue absorbing (yellow) toner particles, while the red separation is developed with red absorbing (cyan) toner particles. The detailed structure of one of the development units will be described hereinafter with reference to FIG. 2.

After development, the now visible image is moved to transfer station where the powder image is transferred to a sheet of final support material 34, such as plain paper amongst others, by means of a transfer member, i.e. a bias transfer roll shown generally by the reference numeral 36. The surface of transfer roll 36 is electrically biased to a potential having a magnitude and polarity sufficient to electrostatically attract toner particles from photoconductive surface 12 to sheet 34. Transfer roll 36 is adapted to secure releasably thereto a single sheet of final support material 34 for movement in a recirculating path therewith. Transfer roll 36 is arranged to move in synchronism with drum 10 enabling sheet 34 to receive, in superimposed registration, successive toner powder images. The aforementioned steps of charging the photoconductive surface, exposing the photoconductive surface to a specific color of the flowing light image of the original document, developing the electrostatic latent image recorded on the photoconductive surface with appropriately colored toner particles, and transferring the toner powder images to a sheet of support material are repeated a plurality of cycles to form a multi-color copy of a color original document.

After the last transfer operation, sheet 34 is stripped from roll 36 and transported to a fusing station (not shown) where the transferred image is permanently fused to sheet 34. Thereafter, sheet 34 is advanced by endless belts (not shown) to a catch tray (not shown) for subsequent removal therefrom by the machine operator.

The last processing station in the direction of rotation of drum 10, as indicated by arrow 14 is cleaning station E. A rotatably mounted fibrous brush 38 is positioned in cleaning station E and maintained in contact with photoconductive surface 12 of rotating drum 10 to remove residual toner particles remaining after the transfer operation.

Figure 2:
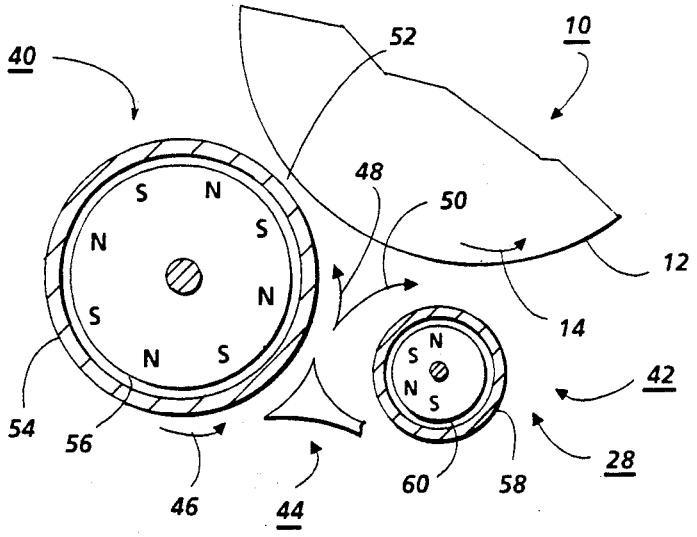
FIG. 2 is a schematic elevational view showing the development apparatus used in the FIG. 1 printing machine.

Referring now to FIG. 2, there is shown development unit 28. Only development unit 28 will be described in detail as development units 30 and 32 are substantially identical thereto, the distinction between each developer unit being the color of the toner particles contained therein and minor geometrical differences to their mounting position. Developer unit 28 may have yellow toner particles, unit 30 magenta toner particles, and unit 32 cyan toner particles although different color combinations may be used. For purposes of explanation, development unit 28 will hereinafter be described in detail.

The principal components of development unit 28 are a developer housing (not shown), a conveyor (not shown), a developer roller, indicated generally by the reference numeral 40, a diverter roller, indicated generally by the reference numeral 42, and a trim blade indicated generally by the reference numeral 44. Developer roller 40, diverter roller 42 and trim blade 44, as well as the conveyor are all disposed in the sump of the developer housing. The conveyor transports the developer material which comprises magnetic carrier granules and yellow toner particles to developer roller 40. Developer roller 40 transports developer material in the direction of arrow 46. Trim blade 44 regulates the quantity of developer material adhering to the surface of developer roller 40. Developer roller 40 is magnetically coupled to diverter roller 42. Thus, in the operative mode, the magnetic field between diverter roller 42 and developer roller 40 is such that the developer material adhering to developer roller 40 advances in the direction of arrow 48 to the electrostatic latent image recorded on photoconductive surface 12 of drum 10. The toner particles are attracted from the carrier granules to the latent image forming a yellow toner powder image on drum 10. At this time, developer units 30 and 32 are inoperative. Alternatively, if one of the other developer units is in the operative mode, i.e. either developer unit 30 or developer unit 32, developer unit 28 must be in the inoperative mode. In the inoperative mode, diverter roller 42 is magnetically coupled to developer roller 40 in such a manner as to magnetically attract the developer material from developer roller 40 thereto. Thus, developer material being advanced by developer 40 is attracted magnetically, in the direction of arrow 50, to diverter roller 42. The developer material is transported by diverter roller 42 back to the sump of the developer housing for subsequent reuse. In this way, substantially no developer material remains adhering to developer roller 40 as it advances to development zone 52. Hence, in the inoperative mode, diverter roller 42 prevents developer roller 40 from advancing the material to development zone 52. This prevents the electrostatic latent image recorded on photoconductive surface 12 of drum 10 from attracting developer material thereto. Thus, the electrostatic latent image remains devoid of toner particles. However, inasmuch as, at this time, either developer unit 30 or developer unit 32, is in the operative mode, the electrostatic latent image is subsequently developed with either magenta or cyan toner particles. In this manner, when the electrostatic latent image is formed with a blue filter, developer unit 28 is operative. At other times, developer unit 28 is inoperative. When the electrostatic latent image is formed with a red filter, developer units 28 and 30 are inoperative and developer unit 32 is operative. Finally, when the electrostatic latent image is formed with a green filter, developer unit 30 is operative and developer units 28 and 32 are inoperative. In this manner, successive electrostatic latent images are developed with differently colored toner particles. As previously indicated, the toner particles form toner powders image on photoconductive surface 12 of drum 10 which are subsequently transferred to support material 34 (FIG. 1) in superimposed registration with one another to form the resultant multicolor toner powder image thereon. Trim blade 44 also assists in removing residual developer material adhering to diverter roller 42.

In the preferred embodiment thereof, developer roller 40 includes a non-magnetic tubular member 54 preferably made from aluminum having an irregular or roughened exterior circumferential surface. Tubular member 54 is journaled for rotation by suitable means such as ball bearing mounts. A shaft, made preferably of a non-magnetic material, such as stainless steel, is concentrically mounted within tubular member 54 and serves as a fixed mounting for magnetic member 56. Magnetic member 56, preferably, is made from barium ferrite or strontium ferrite having magnetic poles impressed about the circumferential surface thereof. Diverter roller 42 includes a non-magnetic tubular member 58 preferably made from aluminum having an irregular or roughened exterior circumferential surface. Tubular member 58 is journaled for rotation by suitable means such as ball bearing mounts. A shaft, made preferably of a non-magnetic material, such as stainless steel, is concentrically mounted within tubular member 58 and functions as a mounting for magnetic 60. Magnet 60 is mounted indexably on the shaft by suitable means such as ball bearing mounts. Magnet 60 preferably, is made from barium ferrite or strontium ferrite having magnets impressed about a portion of the exterior circumferential surface thereof. Alternatively, magnet 60 may be made from discrete magnetic sections mounted in a suitable cylindrical holder made from a suitable low mass material such as aluminum, foam or plastic. This minimizes the mass of the magnet during movement thereof. Magnet 60 is mounted indexably on its support shaft. In the operative mode, wherein diverter roller 42 does not divert developer material from developer roller 40, magnet 60 is positioned so as to minimize the magnetic coupling between diverter roller 42 and developer roller 40. Thus, in the operative mode, magnet 60 is positioned so as to position either a weak magnetic pole opposed from developer roller 40 or substantially no magnetic pole opposed therefrom. In this way, the developer material continues to adhere to developer roller 40 and moves in the direction of arrow 48 rather than being diverted onto diverter roller 42. Alternatively, in the inoperative mode, magnet 60 is oriented so as to maximize the magnetic coupling between diverter roller 42 and developer roller 40. A strong magnetic pole is positioned opposed from developer roller 40. In the inoperative mode of operation, the developer material is attracted from developer roller 40, in the direction of arrow 50, to diverter roller 42. This prevents developer roller 40 from transporting developer material into development zone 52. Under these circumstances, the electrostatic latent image recorded on photoconductive surface 12 of drum 10 is not developed by development unit 28. By way of example, trim blade 44 may be made from a suitable non-magnetic steel, extruded aluminum or a plastic material.

Figure 3:
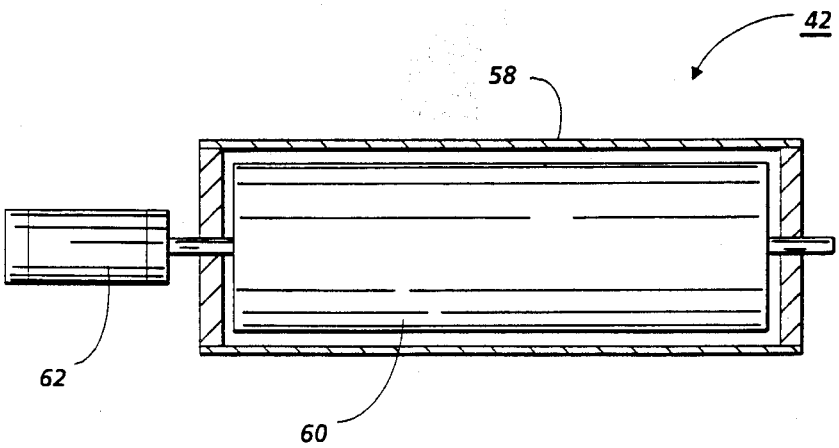
FIG. 3 is an elevational view depicting the indexing of the diverter roller used in the FIG. 2 development apparatus.

Turning now to FIG. 3, there is shown the detailed structure of the indexing mechanism for orienting magnet 60 of diverter roller 42. As shown in FIG. 3, magnet 60 is coupled to indexing motor 62. The printing machine logic automatically actuates motor 62 to index magnet 60 with respect to magnet 56 of developer roller 40. Thus, when the machine logic indicates that a blue filter is in position, indexing motor 62 orients magnet 60 so as to position a weak or no magnetic pole opposed from developer roller 40. This significantly reduces the magnetic coupling between magnet 56 of developer roller 40 and magnet 60. Under these circumstances, developer roller 40 transports the developer mixture into development zone 52 so that the electrostatic latent image recorded on photoconductive surface 12 of drum 10 attracts the yellow toner particles thereto. Alternatively, if the machine logic indicates a red or green filter is being utilized, developer unit 40 is in the inoperative mode. At this time, indexing motor 62 indexes magnet 60 so as to position a strong magnet pole opposed from developer roller 40. This maximizes the magnetic coupling between magnet 56 of developer roller 40 and magnet 60 of diverter roller 42. Under these circumstances, the developer material being advanced by developer roller 40 is diverted away from development zone 52 onto diverter roller 42 for return to the sump of the development housing. Thus, no yellow toner particles are transported to the electrostatic latent image and the electrostatic latent image may be developed with either cyan or magenta toner particles.

In recapitulation, the development apparatus of the present invention employs a magnetic developer roller and magnetic diverter roller. The magnetic diverter roller attracts the toner particles from the developer roller preventing development of the electrostatic latent image in the inoperative mode. Alternatively, in the operative mode, the diverter roller does not attract the developer material from the developer roller and the developer material is advanced by the developer roller into the development zone so as to develop the electrostatic latent image recorded on the photoconductive surface with the appropriately colored toner particles.

It is, therefore, evident that there has been provided in accordance with the present invention, a development apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus of the type in which a latent image recorded on a member with a developed marking particles, including:

means, spaced from the member, for transporting magnetically marking particles toward the member; and means, spaced from said transporting means and the member for controlling magnetically the marking particles being moved by said transporting means so that in one mode of operation the marking particles are advanced to the member so that marking particles are attracted to the latent image recorded on the member, and in another mode of operation the marking particles being advanced by said transporting means are diverted away from the member to said controlling means to prevent the marking particles from being attracted to the latent image recorded on the member.

2. An apparatus according to claim 1, wherein said transporting means includes:

a tubular member journalled for rotation; and means for attracting magnetically marking particles to said tubular member.

3. An apparatus according to claim 2, wherein said controlling means includes:

a sleeve journalled for rotation;

a magnetic member disposed interiorly of said sleeve; and means for indexing said magnetic member so that in one orientation said magnetic member cooperates with said attracting means to enable said tubular member to advance the marking particles to the latent image and in another orientation said magnetic member cooperates with said attracting means to divert the marking particles from the latent image.

4. An apparatus according to claim 3, wherein said attracting means includes a magnet disposed interiorly of said tubular member.

5. An apparatus according to claim 4, further including means for regulating the quantity of marking particles on said tubular member.

6. An electrophotographic printing machine of the type having an electrostatic latent image recorded on a photoconductive member, wherein the improvement includes:

means, spaced from the photoconductive member, for transporting magnetically marking particles toward the photoconductive member; and means, spaced from said transporting means and the photoconductive member, for controlling magnetically the marking particles being moved by said transporting means so that in one mode of operation the marking particles are advanced to the photoconductive member so that marking particles are attracted to the latent image recorded on the photoconductive member, and in another mode of operation the marking particles being advanced by said transporting means are diverted away from the photoconductive member to said controlling means to prevent the marking particles from being attracted to the latent image recorded on the photoconductive member.

7. A printing machine according to claim 6, wherein said transporting means includes:

a tubular member journalled for rotation; and means for attracting magnetically marking particles to said tubular member.

8. A printing machine according to claim 7, wherein said controlling means includes;

a sleeve journalled for rotation;

a magnetic member disposed interiorly of said sleeve; and means for indexing said magnetic member so that in one orientation said magnetic member cooperates with said attracting means to enable said tubular member to advance the marking particles to the latent image and in another orientation said magnetic member cooperates with said attracting means to divert the marking particles from the latent image.

9. A printing machine according to claim 8, wherein said attracting means includes a magnet disposed interiorly of said tubular member.

10. A printing machine according to claim 9, further including means for regulating the quantity of marking particles on said tubular member.

11. An electrophotographic printing machine of the type in which a first electrostatic latent image recorded on a photoconductive member is developed with marking particles of one color and a second electrostatic latent image recorded on the photoconductive member is developed with marking particles of another color, wherein the improvement includes:

a first developer unit for developing the first electrostatic latent image with marking particles of one color, said first developer unit comprising first means, spaced from the photoconductive member, for transporting magnetically the marking particles of one color toward the photoconductive member, and first means, spaced from said first transporting means and the photoconductive member, for controlling magnetically the marking particles being moved by said first transporting means so that in one mode of operation the marking particles are advanced to the photoconductive member so that marking particles are attracted to the first electrostatic latent image recorded on the photoconductive member to develop the first electrostatic latent image with the marking particles of one color, and in another mode of operation the marking particles being advanced by said first transporting means are diverted away from the photoconductive member to prevent the marking particles from being attracted to the second electrostatic latent image recorded on the photoconductive member; and a second developer unit for developing the second electrostatic latent image with marking particles of another color, said second developer unit comprising second means, spaced from the photoconductive member, for transporting magnetically marking particles of the other color toward the photoconductive member, and second means, spaced from said first transporting means and the photoconductive member for controlling magnetically the marking particles being moved by said second transporting means so that in one mode of operation the marking particles are advanced to the photoconductive member so that marking particles are attracted to the second electrostatic latent image recorded on the photoconductive member to develop the latent image with marking particles of the other color, and in another mode of operation the marking particles being advanced by said second transporting means are diverted away from the photoconductive member to prevent the marking particles from being attracted to the first electrostatic latent image recorded on the photoconductive member.

12. A printing machine according to claim 11, wherein:

said first transporting means includes a first tubular member journalled for rotation, and first means for attracting magnetically marking particles to said first tubular member; and said second transporting means includes a second tubular member journalled for rotation, and second means for attracting magnetically marking particles to said second tubular member.

13. A printing machine according to claim 12, wherein:

said first controlling means includes a first sleeve journalled for rotation, a first magnetic member disposed interiorly of said first sleeve, and first means for indexing said first magnetic member so that in one orientation said first magnetic member cooperates with said first attracting means to enable said first tubular member to advance the marking particles to the first electrostatic latent image and in another orientation said first magnetic member cooperates with said first attracting means to divert the marking particles from the second electrostatic latent image; and said second controlling means includes a second sleeve journalled for rotation, a second magnetic member disposed interiorly of said second sleeve, and second means for indexing said second magnetic member so that in one orientation said second magnetic member cooperates with said second attracting means to enable said second tubular member to advance the marking particles to the second electrostatic latent image and in another orientation said second magnetic member cooperates with said second attracting means to divert the marking particles from the first electrostatic latent image.

14. A printing machine according to claim 13, wherein:

said first attracting means includes a first magnet disposed interiorly of said first tubular member; and said second attracting means includes a second magnet disposed interiorly of said second tubular member.

15. A printing machine according to claim 14, further including:

first means for regulating the quantity of marking particles on said first tubular member; and second means for regulating the quantity of marking particles on said second tubular member.

* * * * *